US011867448B2

(12) United States Patent
Choi et al.

(10) Patent No.: US 11,867,448 B2
(45) Date of Patent: Jan. 9, 2024

(54) REFRIGERATOR AND METHOD FOR CONTROLLING THE SAME

(71) Applicant: LG ELECTRONICS INC., Seoul (KR)

(72) Inventors: Sangbok Choi, Seoul (KR); Kyongbae Park, Seoul (KR); Sungwook Kim, Seoul (KR); Sung Jhee, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 225 days.

(21) Appl. No.: 17/032,566

(22) Filed: Sep. 25, 2020

(65) Prior Publication Data

US 2021/0025639 A1 Jan. 28, 2021

Related U.S. Application Data

(63) Continuation of application No. PCT/KR2019/003205, filed on Mar. 19, 2019.

(30) Foreign Application Priority Data

Mar. 26, 2018 (KR) ..... 10-2018-0034490

(51) Int. Cl.
*F25D 21/00* (2006.01)
*F25D 21/08* (2006.01)
*F25D 21/02* (2006.01)

(52) U.S. Cl.
CPC ..... *F25D 21/006* (2013.01); *F25D 21/02* (2013.01); *F25D 21/08* (2013.01); *F25D 2700/02* (2013.01)

(58) Field of Classification Search
CPC ..... F25D 21/006; F25D 2400/04; F25D 2700/12; F25D 21/02; F25B 2700/2117; F25B 2600/112; F25B 2400/01
See application file for complete search history.

(56) References Cited

U.S. PATENT DOCUMENTS

| | | | | |
|---|---|---|---|---|
| 3,355,904 A | | 12/1967 | Sutton, Jr. et al. | |
| 3,465,534 A | | 9/1969 | Sutton, Jr. et al. | |
| 3,643,457 A | | 2/1972 | Winkler | |
| 5,934,088 A | * | 8/1999 | Takeda | F25B 49/005 62/127 |
| 9,127,875 B2 | * | 9/2015 | Hall | F25D 21/006 |
| 9,557,091 B1 | * | 1/2017 | Zardo | F25D 23/061 |
| 10,718,561 B2 | | 7/2020 | Cho et al. | |

(Continued)

FOREIGN PATENT DOCUMENTS

| | | |
|---|---|---|
| CA | 950555 A | 7/1974 |
| CN | 101545707 A | 9/2009 |

(Continued)

*Primary Examiner* — Nelson J Nieves
*Assistant Examiner* — Meraj A Shaikh
(74) *Attorney, Agent, or Firm* — BRYAN CAVE LEIGHTON PAISNER LLP

(57) ABSTRACT

A method for controlling a refrigerator includes operating, for a set duration, a heating element of a sensor which responds to changes in air flow; sensing the temperature of the heating element in on or off state; and sensing residual frost on an evaporator on the basis of the difference in value of the temperature between a first sensed temperature, which is the lowest value, and a second sensed temperature, which is the highest value, from among the sensed temperatures of the heating element.

20 Claims, 13 Drawing Sheets

(56) References Cited

U.S. PATENT DOCUMENTS

| | | | |
|---|---|---|---|
| 2017/0038125 | A1 | 2/2017 | Tani et al. |
| 2021/0055034 | A1 | 2/2021 | Choi et al. |

FOREIGN PATENT DOCUMENTS

| | | | | | |
|---|---|---|---|---|---|
| CN | 102384614 | A | | 3/2012 | |
| CN | 204854130 | U | | 12/2015 | |
| CN | 106461253 | A | | 2/2017 | |
| CN | 205919601 | U | | 2/2017 | |
| CN | 106802051 | A | | 6/2017 | |
| CN | 107166866 | A | | 9/2017 | |
| EP | 3 764 033 | A1 | | 1/2021 | |
| GB | 1 586 308 | A | | 3/1981 | |
| JP | S59-185968 | A | | 10/1984 | |
| JP | S60 226688 | A | | 11/1985 | |
| JP | H01-312378 | A | | 12/1989 | |
| JP | H07-146306 | A | | 6/1995 | |
| JP | 08303932 | A | * | 11/1996 | ..... F25D 21/12 |
| JP | 0979710 | A | | 3/1997 | |
| JP | H10197135 | A | | 7/1998 | |
| JP | 2000205737 | A | | 7/2000 | |
| JP | 2011174651 | A | | 9/2011 | |
| KR | 10-2000-0004806 | A | | 1/2000 | |
| KR | 10-2000-0018782 | A | | 4/2000 | |
| KR | 1536284 | B1 | * | 7/2015 | |
| KR | 101536284 | B1 | | 7/2015 | |
| KR | 10-2016-0027761 | A | | 3/2016 | |
| WO | 2014137060 | A1 | | 9/2014 | |
| WO | WO-2014137060 | A1 | * | 9/2014 | ..... F25D 21/006 |
| WO | 2017131426 | A1 | | 8/2017 | |

* cited by examiner

【Figure 1】
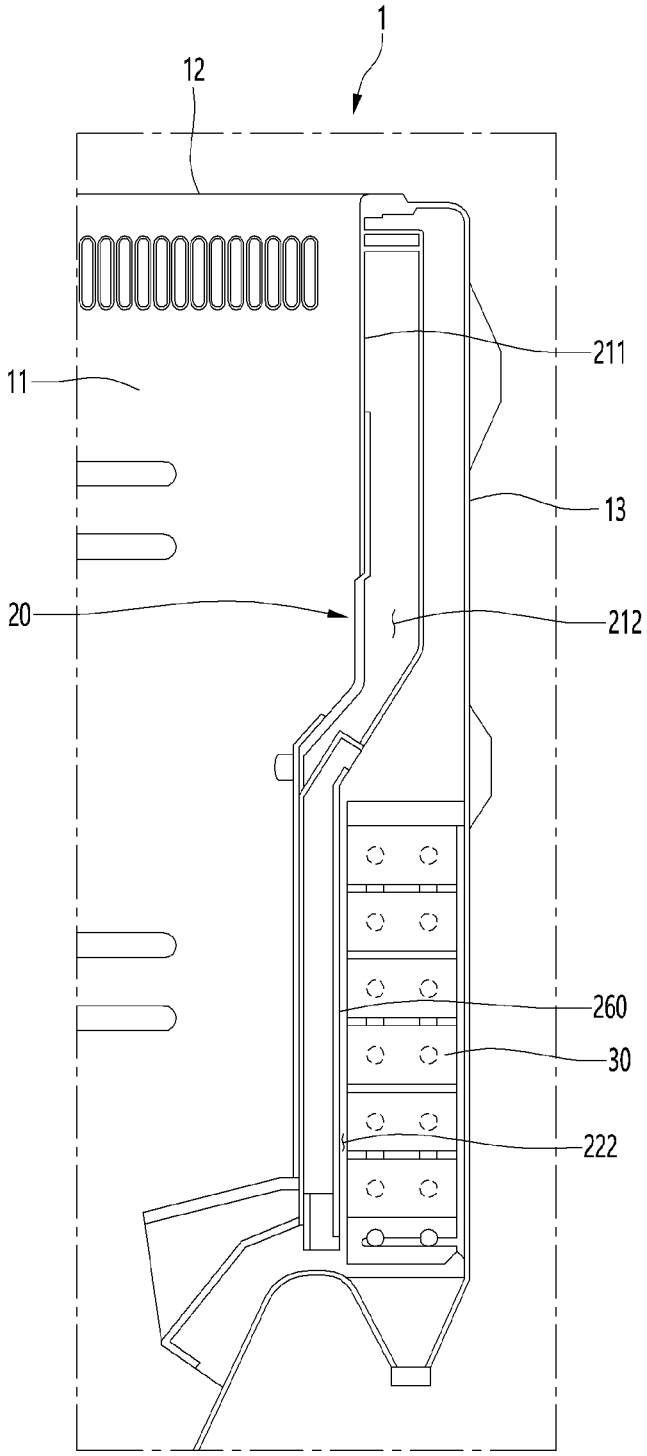

【Figure 2】
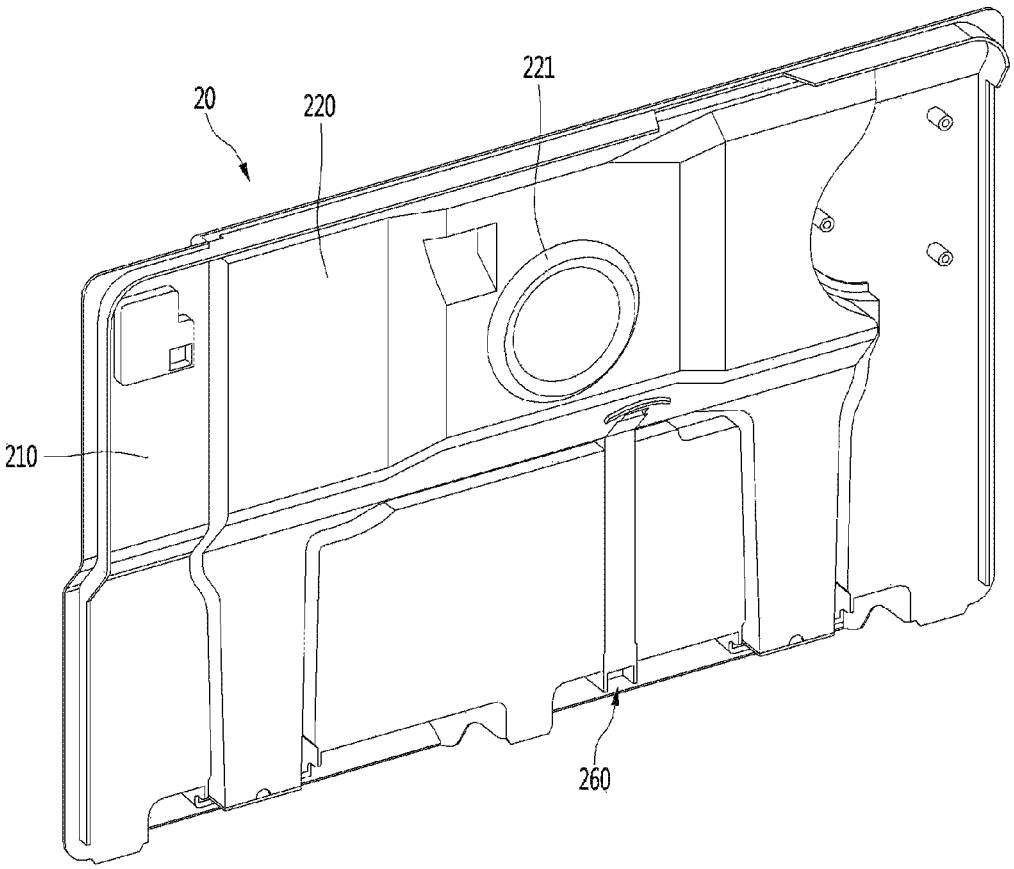

【Figure 3】
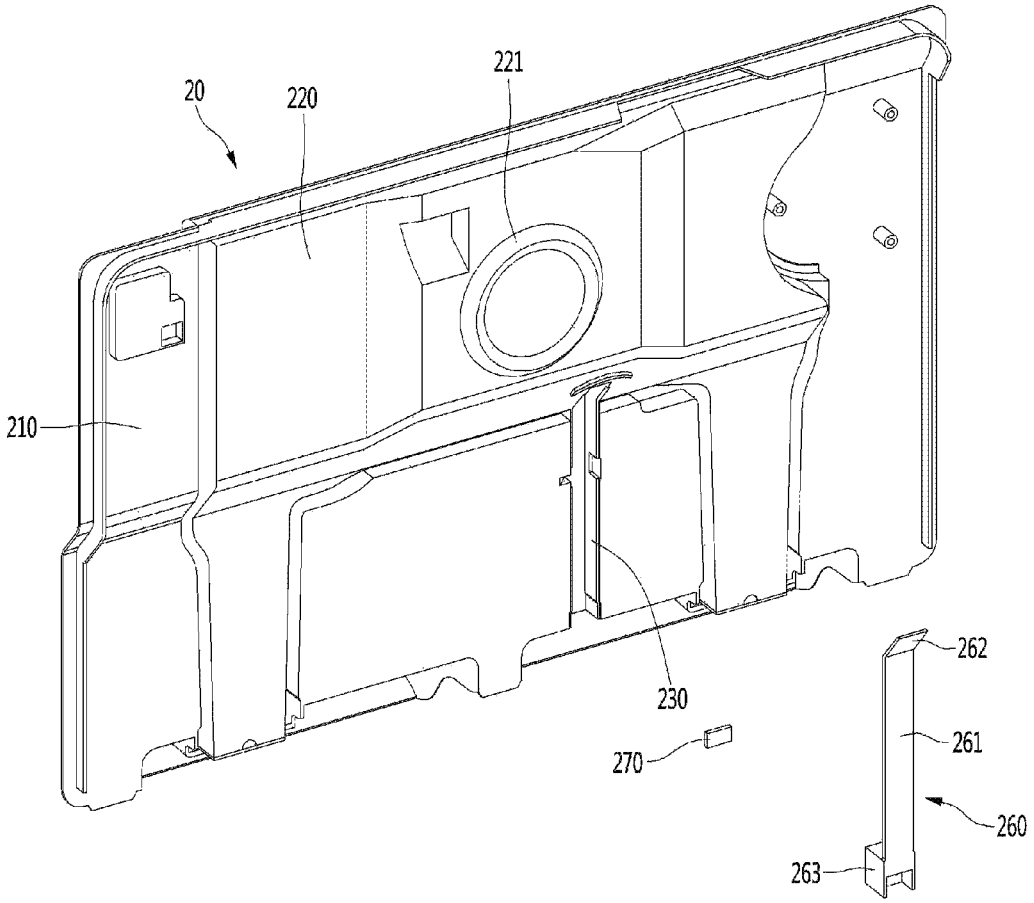

【Figure 4a】
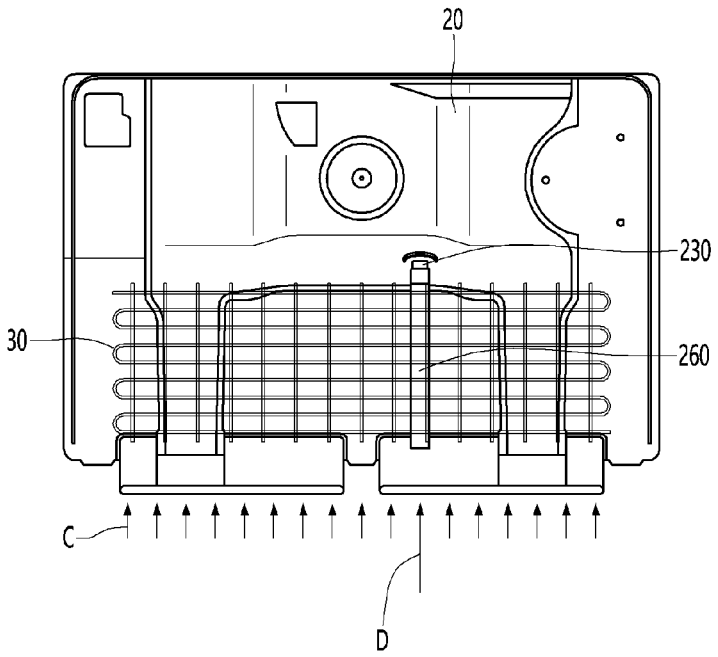
【Figure 4b】
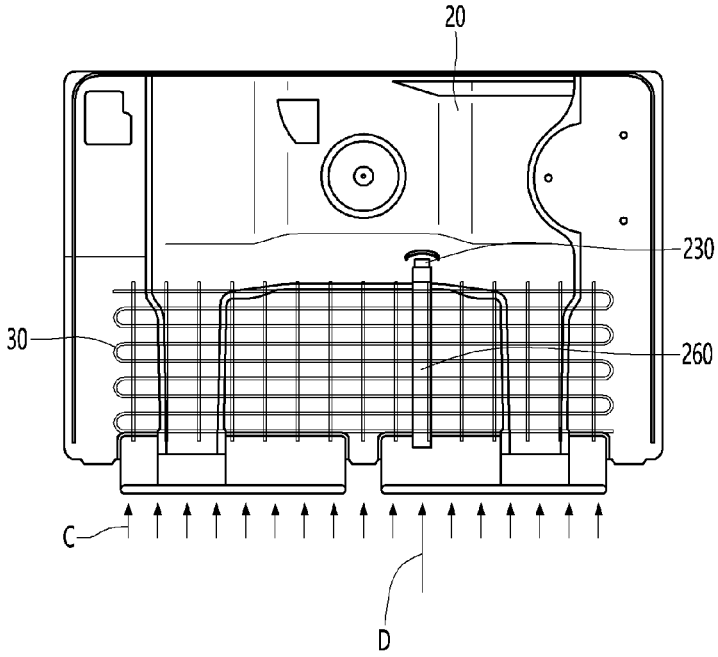

【Figure 5】
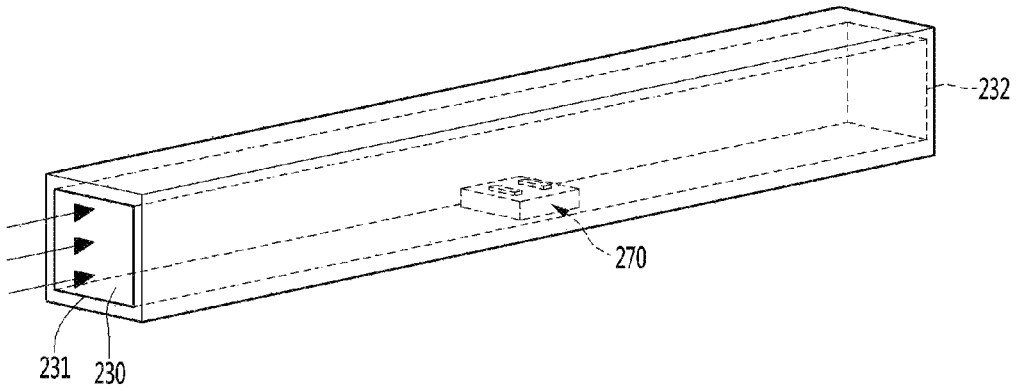

【Figure 6】
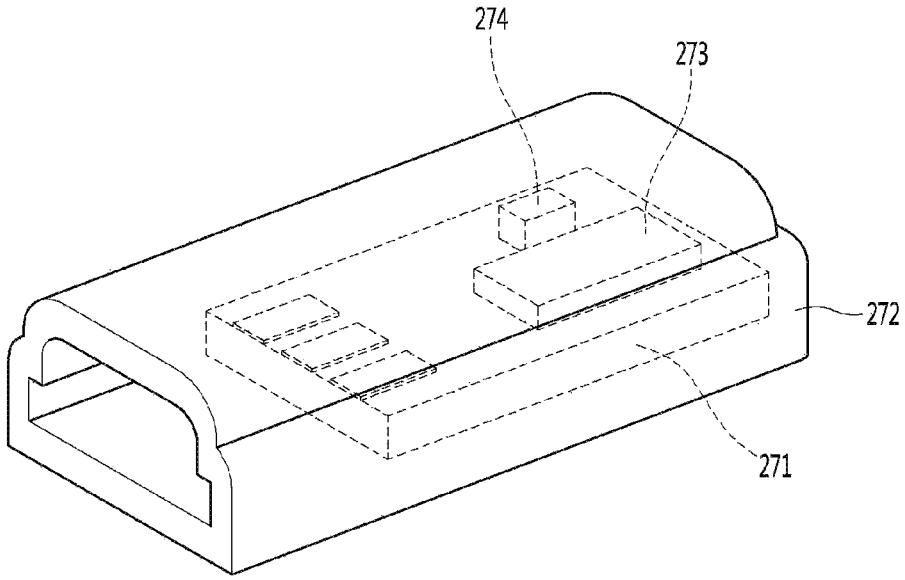

【Figure 7】
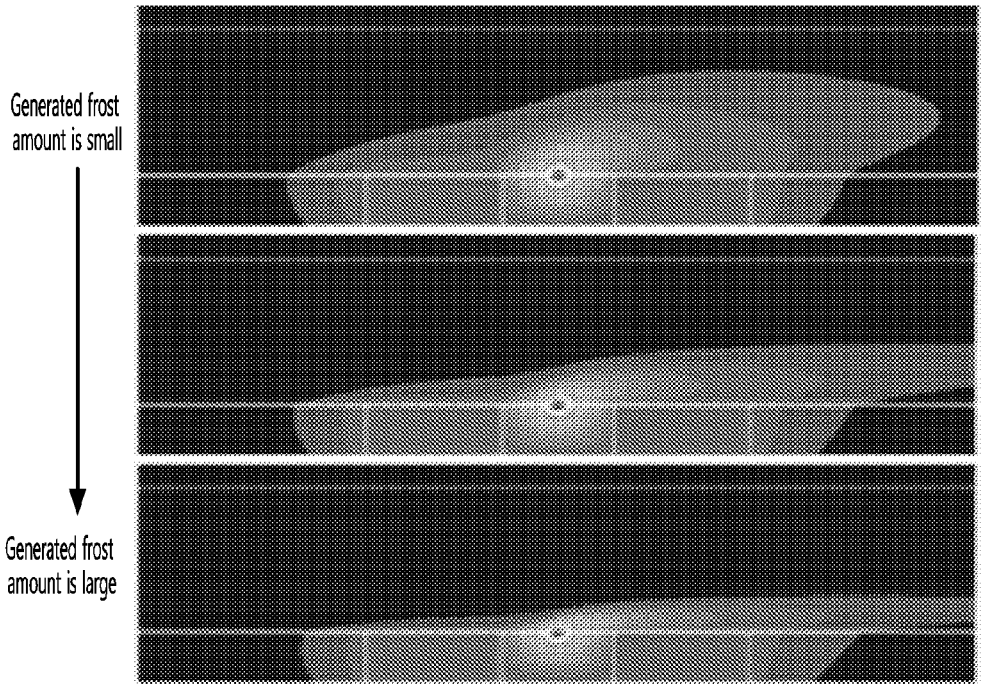
Thermal flow simulation depending on flow rate

【Figure 8】
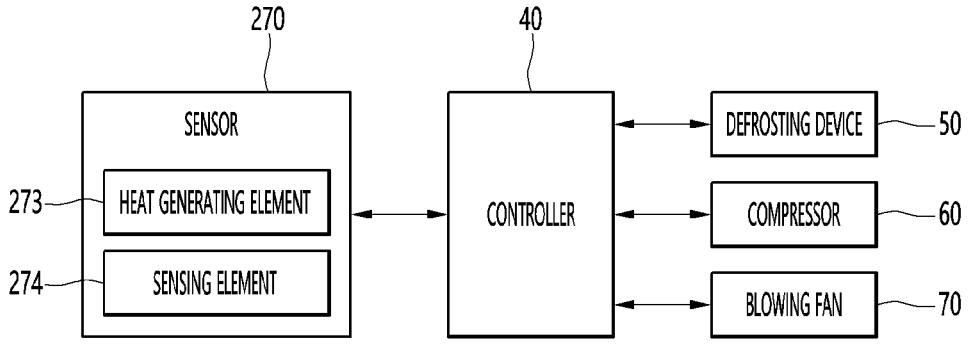

【Figure 9】
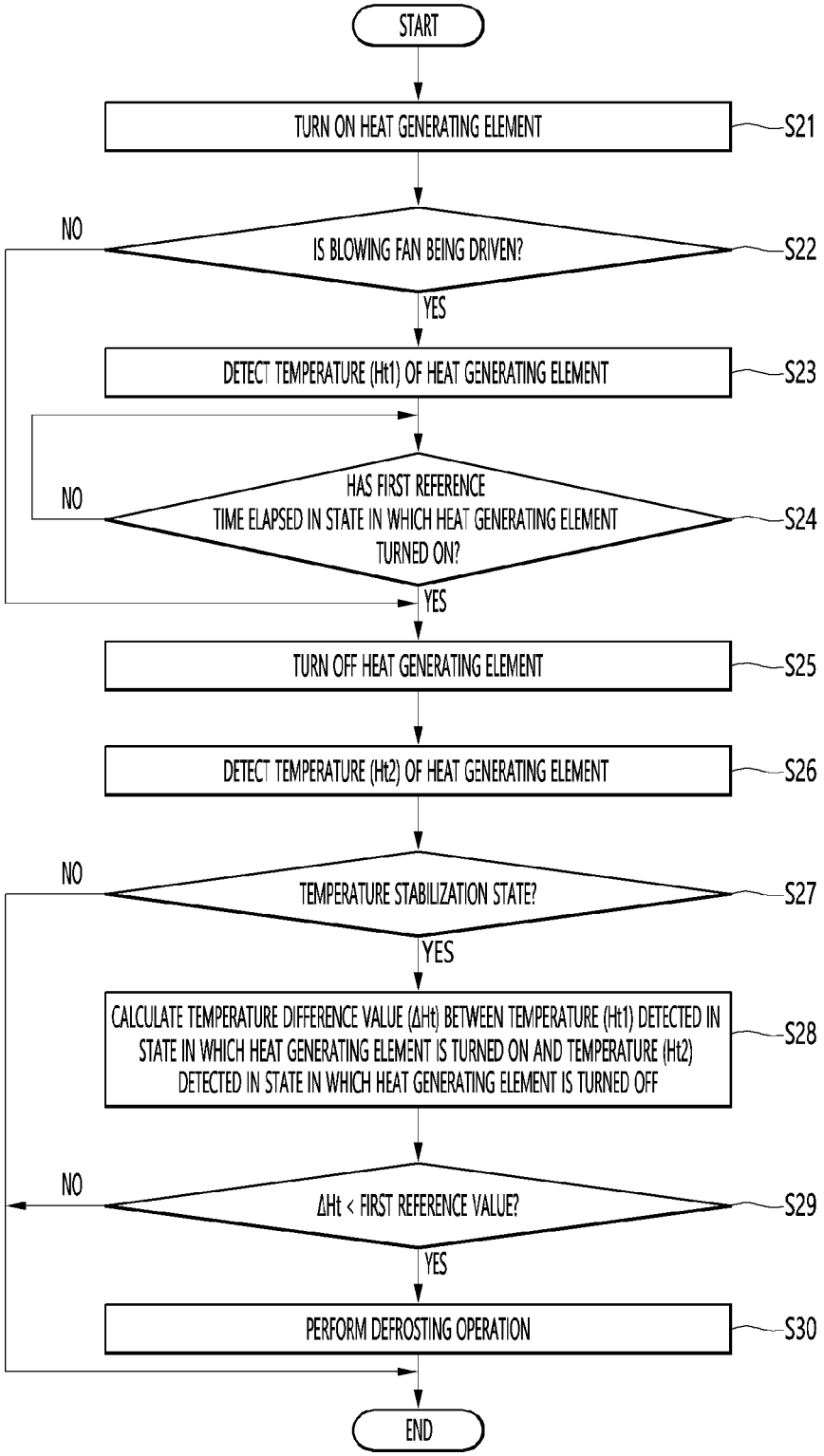

【Figure 10a】
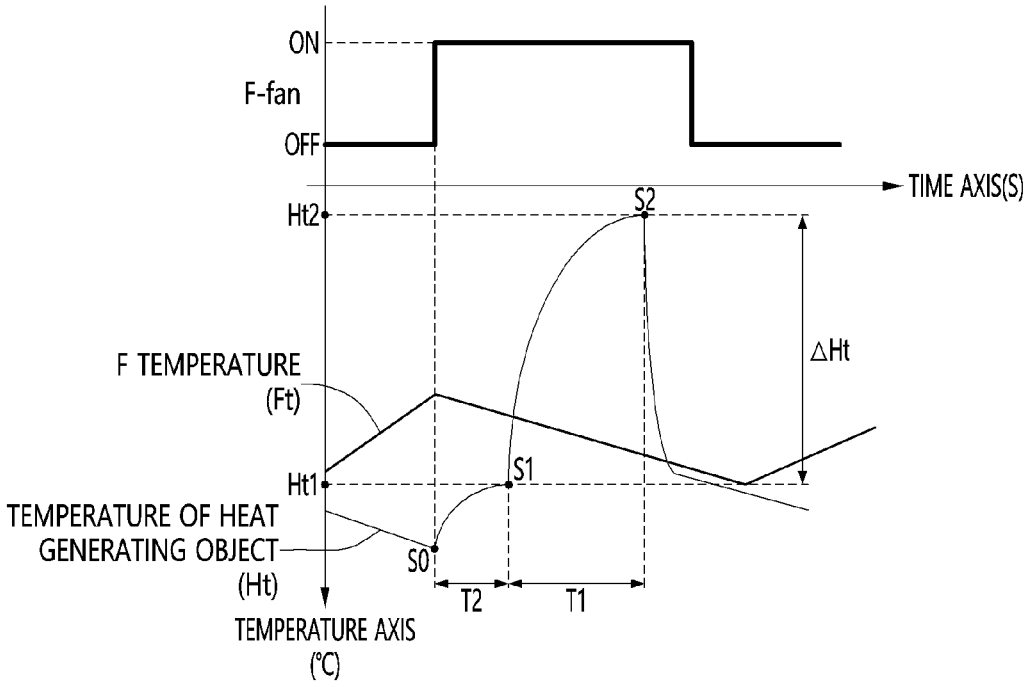

【Figure 10b】
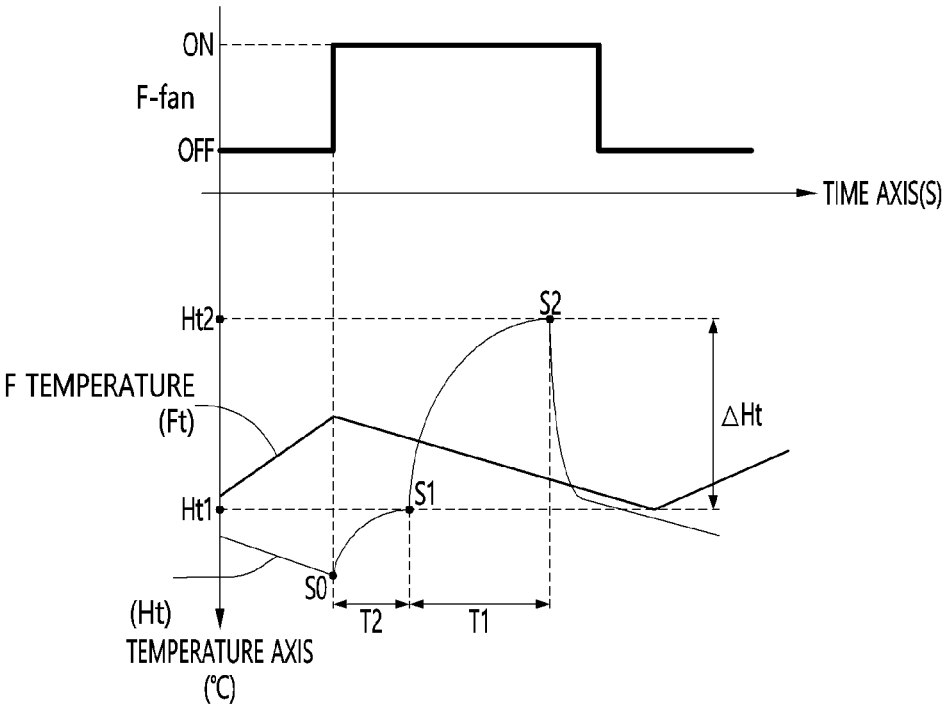

【Figure 11】
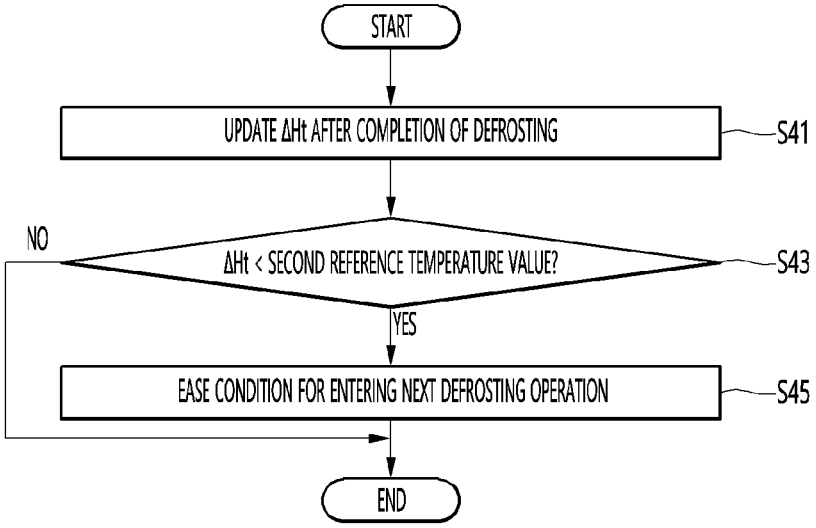

【Figure 12】
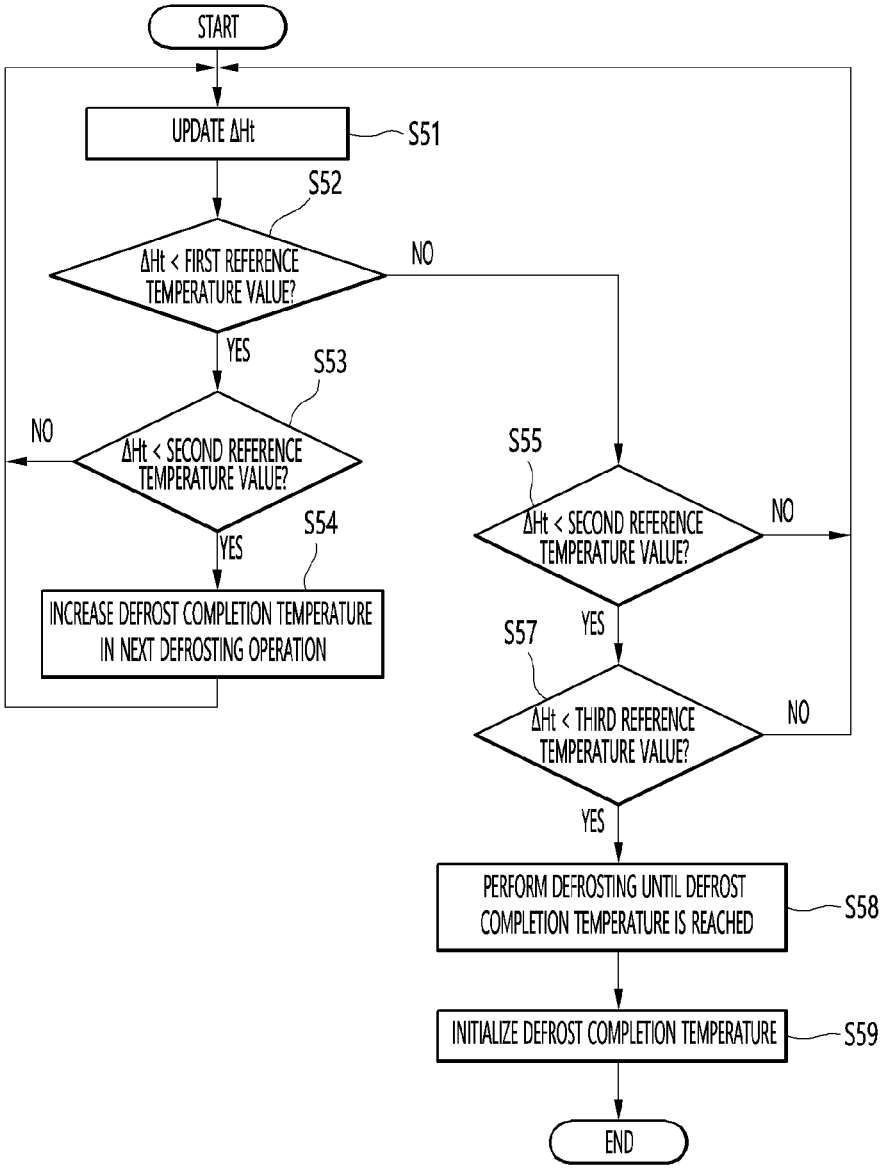

REFRIGERATOR AND METHOD FOR CONTROLLING THE SAME

This application is a continuation of International Application No. PCT/KR2019/003205, filed Mar. 19, 2019, which claims the benefit of Korean Patent Application No. 10-2018-0034490, filed Mar. 26, 2018, the contents of which are all hereby incorporated by reference herein in their entirety.

TECHNICAL FIELD

The present disclosure relates to a refrigerator and a method from controlling the same.

BACKGROUND ART

Refrigerators are household appliances that are capable of storing objects such as food at a low temperature in a storage space provided in a cabinet. Since the storage space is surrounded by heat insulation wall, the inside of the storage space may be maintained at a temperature less than an external temperature.

The storage space may be classified into a refrigerating storage space or a freezing storage space according to a temperature range of the storage space.

The refrigerator may further include an evaporator for supplying cool air to the storage space. Air in the storage space is cooled while flowing to a space, in which the evaporator is disposed, so as to be heat-exchanged with the evaporator, and the cooled air is supplied again to the storage space.

Here, if the air heat-exchanged with the evaporator contains moisture, when the air is heat-exchanged with the evaporator, the moisture freezes on a surface of the evaporator to generate frost on the surface of the evaporator.

Since flow resistance of the air acts on the frost, the more an amount of frost frozen on the surface of the evaporator increases, the more the flow resistance increases. As a result, heat-exchange efficiency of the evaporator may be deteriorated, and thus, power consumption may increase.

Thus, the refrigerator further includes a defroster for removing the frost on the evaporator.

A defrosting cycle variable method is disclosed in Korean Patent Publication No. 2000-0004806.

In the publication, the defrosting cycle is adjusted using a cumulative operation time of the compressor and an external temperature.

However, when the defrosting cycle is determined only using the cumulative operation time of the compressor and the external temperature, an amount of frost (hereinafter, referred to as a frost generation amount) on the evaporator is not reflected. Thus, it is difficult accurately determine the time point at which the defrosting is required.

That is, the frost generation amount may increase or decrease according to various environments such as the user's refrigerator usage pattern and the degree to which air retains moisture. In the case of the publication, there is a disadvantage in that the defrosting cycle is determined without reflecting the various environments.

Moreover, in the case of the publication, there is a disadvantage in that it is difficult to identify an exact defrost time point since the amount of local frost on the evaporator can be detected but the amount of frost on the entire evaporator cannot be detected.

Accordingly, there is a disadvantage in that the defrosting does not start despite a large amount of generated frost to deteriorate cooling performance, or the defrosting starts despite a low frost generation amount to increase in power consumption due to the unnecessary defrosting.

SUMMARY

An object of the present disclosure is to provide a refrigerator and a control method thereof, which determines a time point for a defrosting operation using parameters that vary depending on the amount of frost on an evaporator.

In addition, an object of the present disclosure is to provide a refrigerator and a control method thereof, which accurately determine a time point at which defrosting is necessary according to the amount of frost on an evaporator using a sensor having an output value that varies depending on the flow rate of air.

In addition, another object of the present disclosure is to provide a refrigerator and a control method thereof, which accurately determine an exact defrost time point even when the precision of a sensor used to determine the defrost time point is low.

Still another object of the present disclosure is to provide a refrigerator capable of determining whether residual frost exists on an evaporator even though a defrosting operation has been completed, and a control method thereof.

Still another object of the present disclosure is to provide a refrigerator capable of advancing a next defrost time point or increasing a next defrosting operation time when residual frost exists on the evaporator after completion of defrosting, and a control method thereof.

Technical Solution

A control method of a refrigerator may include detecting residual frost on an evaporator based on a temperature difference between a first detection temperature (Ht1) that is a lowest value and a second detection temperature (Ht2) that is a highest value among detection temperatures of the heat generating element.

In this case, the first detection temperature (Ht1) may be a temperature detected by a sensing element of the sensor immediately after the heat generating element is turned on, and the second detection temperature (Ht2) may be a temperature detected by a sensing element of the sensor immediately after the heat generating element is turned off.

Further, the first detection temperature (Ht1) may be a lowest temperature value during a period of time when the heat generating element is turned on and the second detection temperature (Ht2) may be a highest temperature value after the heat generating element is turned on.

According to an embodiment, the method may further include performing a defrosting operation of the evaporator when a temperature difference value between the first detection temperature (Ht1) and the second detection temperature (Ht2) is less than a first reference value.

The method may further include updating a temperature difference value between the first detection temperature (Ht1) and the second detection temperature (Ht2) after the defrosting operation is completed, and a condition for entering a next defrosting operation may be eased when the updated temperature difference value is less than the second reference value.

The second reference value may have a value higher than the first reference value.

The first reference value for performing the next defrosting operation may be increased when the updated temperature difference value is less than the second reference value or a total operation time of the next defrosting operation may be increased by increasing a defrost completion temperature when the updated temperature difference value is less than the second reference value.

Accordingly, it is possible to determine whether residual frost exists on the evaporator after the defrosting operation is completed, and according to the presence or absence of residual frost, the next defrost time point may be advanced or the next defrosting operation time may be increased.

The method may further include determining whether the temperature difference value between the first detection temperature (Ht1) and the second detection temperature (Ht2) is updated for the first time after the defrosting operation is completed, and a total operation time of a next defrosting operation may be increased by increasing a defrost completion temperature in the next defrosting operation when the temperature difference value between the first detection temperature (Ht1) and the second detection temperature (Ht2) is updated for the first time after the defrosting operation is completed.

The third reference value may have a value less than the first reference value and higher than the second reference value.

The method may further include determining whether the updated temperature difference value is less than a third reference value when it is determined that the temperature difference value between the first detection temperature (Ht1) and the second detection temperature (Ht2) is updated after the defrosting operation is completed and again performing the defrosting operation when the updated temperature difference value is less than the third reference value.

According to an embodiment of the present disclosure, a refrigerator may include a controller configured to detect residual frost on the evaporator based on a temperature difference between a first detection temperature (Ht1) that is a lowest value and a second detection temperature (Ht2) that is a highest value among detection temperatures of a heat generating element.

Advantageous Effects

Since the time point at which the defrosting is required is determined using the sensor having the output value varying according to the amount of frost generated on the evaporator in the bypass passage, the time point at which the defrosting is required may be accurately determined.

In addition, even when the precision of a sensor used to determine a defrost time point is low, it is possible to accurately determine the defrost time point, thus significantly reducing the cost of the sensor.

Accordingly, it is possible to determine whether residual frost exists on the evaporator after the defrosting operation is completed, and according to the presence or absence of residual frost, the next defrost time point may be advanced or the next defrosting operation time may be increased, thus effectively removing residual frost remaining on the evaporator. Therefore, there is an advantage of remarkably maintaining cooling performance and reducing power consumption of the refrigerator.

DESCRIPTION OF DRAWINGS

FIG. 1 is a schematic longitudinal cross-sectional view of a refrigerator according to an embodiment of the present disclosure.

FIG. 2 is a perspective view of a cool air duct according to an embodiment of the present disclosure.

FIG. 3 is an exploded perspective view illustrating a state in which a passage cover and a sensor are separated from each other in the cool air duct.

FIGS. 4(*a*) and 4(*b*) are views illustrating a flow of air in a heat exchange space and a bypass passage before and after frost is generated.

FIG. 5 is a schematic view illustrating a state in which a sensor is disposed in the bypass passage.

FIG. 6 is a view of the sensor according to an embodiment of the present disclosure.

FIG. 7 is a view illustrating a thermal flow around the sensor depending on a flow of air flowing through the bypass passage.

FIG. 8 is a control block diagram of a refrigerator according to an embodiment of the present disclosure.

FIG. 9 is a flowchart showing a method of performing a defrost operation by determining a time point when a refrigerator needs to be defrosted according to an embodiment of the present disclosure.

FIGS. 10(*a*) and 10(*b*) are views showing changes in a temperature of a heat generating element according to the on/off of the heat generating element before and after frost on the evaporator according to an embodiment of the present disclosure.

FIG. 11 is a flowchart schematically showing a method of detecting residual ice in an evaporator after defrosting is completed according to an embodiment of the present disclosure.

FIG. 12 is a flow chart showing a detailed method of detecting residual ice in an evaporator after defrosting is completed according to an embodiment of the present disclosure.

DETAILED DESCRIPTION

Hereinafter, some embodiments of the present invention will be described in detail with reference to the accompanying drawings. Exemplary embodiments of the present invention will be described below in more detail with reference to the accompanying drawings. It is noted that the same or similar components in the drawings may be designated by the same reference numerals as far as possible even if they are shown in different drawings. Further, in the description of embodiments of the present disclosure, when it is determined that detailed descriptions of well-known configurations or functions obscure the understanding of the embodiments of the present disclosure, the detailed descriptions may be omitted.

Also, in the description of the embodiments of the present disclosure, the terms such as first, second, A, B, (a) and (b) may be used. Each of the terms is merely used to distinguish the corresponding component from other components, and does not delimit an essence, an order or a sequence of the corresponding component. It should be understood that when one component is "connected", "coupled" or "joined" to another component, the former may be directly connected or jointed to the latter or may be "connected", coupled" or "joined" to the latter with a third component interposed therebetween.

FIG. 1 is a schematic longitudinal cross-sectional view of a refrigerator according to an embodiment of the present disclosure, FIG. 2 is a perspective view of a cool air duct according to an embodiment of the present disclosure, and FIG. 3 is an exploded perspective view illustrating a state in which a passage cover and a sensor are separated from each other in the cool air duct.

Referring to FIGS. 1 to 3, a refrigerator 1 according to an embodiment of the present disclosure may include an inner case 12 defining a storage space 11.

The storage space may include one or more of a refrigerating storage space and a freezing storage space.

A cool air duct 20 providing a passage, through which cool air supplied to the storage space 11 flows, is disposed in a rear space of the storage space 11. Also, an evaporator 30 is disposed between the cool air duct 20 and a rear wall 13 of the inner case 12. A heat exchange space 222 in which the evaporator 30 is disposed is defined between the cool air duct 20 and the rear wall 13.

Thus, air of the storage space 11 may flow to the heat exchange space 222 between the cool air duct 20 and the rear wall 13 of the inner case 12 and then be heat-exchanged with the evaporator 30. Thereafter, the air may flow through the inside of the cool air duct 20 and then be supplied to the storage space 11.

The cool air duct 20 may include, but is not limited thereto, a first duct 210 and a second duct 220 coupled to a rear surface of the first duct 210.

A front surface of the first duct 210 is a surface facing the storage space 11, and a rear surface of the second duct 220 is a surface facing the rear wall 13 of the inner case 12.

A cool air passage 212 may be provided between the first duct 210 and the second duct 220 in a state in which the first duct 210 and the second duct 220 are coupled to each other.

Also, a cool air inflow hole 221 may be defined in the second duct 220, and a cool air discharge hole 211 may be defined in the first duct 210.

A blower fan (not shown) may be provided in the cool air passage 212. Thus, when the blower fan rotates, air passing through the evaporator 30 is introduced into the cool air passage 212 through the cool air inflow hole 221 and is discharged to the storage space 11 through the cool air discharge hole 211.

The evaporator 30 is disposed between the cool air duct 20 and the rear wall 13. Here, the evaporator 30 may be disposed below the cool air inflow hole 221.

Thus, the air in the storage space 11 ascends to be heat-exchanged with the evaporator 30 and then is introduced into the cool air inflow hole 221.

According to this arrangement, when an amount of frost generated on the evaporator 30 increases, an amount of air passing through the evaporator 30 may be reduced to deteriorate heat exchange efficiency.

In this embodiment, a time point at which defrosting for the evaporator 30 is required may be determined using a parameter that is changed according to the amount of frost generated on the evaporator 30.

For example, the cool air duct 20 may further include a frost generation sensing portion configured so that at least a portion of the air flowing through the heat exchange space 222 is bypassed and configured to determine a time point, at which the defrosting is required, by using the sensor having a different output according to a flow rate of the air.

The frost generation sensing portion may include a bypass passage 230 bypassing at least a portion of the air flowing through the heat exchange space 222 and a sensor 270 disposed in the bypass passage 230.

Although not limited, the bypass passage 230 may be provided in a recessed shape in the first duct 210. Alternatively, the bypass passage 230 may be provided in the second duct 220.

The bypass passage 230 may be provided by recessing a portion of the first duct 210 or the second duct 220 in a direction away from the evaporator 30.

The bypass passage 230 may extend from the cool air duct 20 in a vertical direction.

The bypass passage 230 may be disposed to face the evaporator 30 within a left and right width range of the evaporator 30 so that the air in the heat exchange space 222 is bypassed to the bypass passage 230.

The frost generation sensing portion may further include a passage cover 260 that allows the bypass passage 230 to be partitioned from the heat exchange space 222.

The passage cover 260 may be coupled to the cool air duct 20 to cover at least a portion of the bypass passage 230 extending vertically.

The passage cover 260 may include a cover plate 261, an upper extension portion 262 extending upward from the cover plate 261, and a barrier 263 provided below the cover plate 261.

FIGS. 4(*a*) and 4(*b*) are views illustrating a flow of air in the heat exchange space and the bypass passage before and after frost is generated.

FIG. 4(*a*) illustrates a flow of air before frost is generated, and FIG. 4(*b*) illustrates a flow of air after frost is generated. In this embodiment, as an example, it is assumed that a state after a defrosting operation is completed is a state before frost is generated.

First, referring to FIG. 4(*a*), in the case in which frost does not exist on the evaporator 30, or an amount of generated frost is remarkably small, most of the air passes through the evaporator 30 in the heat exchange space 222 (see arrow A). On the other hand, some of the air may flow through the bypass passage 230 (see arrow B).

Referring to FIG. 4(*b*), when the amount of frost generated on the evaporator 30 is large (when the defrosting is required), since the frost of the evaporator 30 acts as flow resistance, an amount of air flowing through the heat exchange space 222 may decrease (see arrow C), and an amount of air flowing through the bypass passage 230 may increase (see arrow D).

As described above, the amount (or flow rate) of air flowing through the bypass passage 230 varies according to an amount of frost generated on the evaporator 30.

In this embodiment, the sensor 270 may have an output value that varies according to a change in flow rate of the air flowing through the bypass passage 230. Thus, whether the defrosting is required may be determined based on the change in output value.

Hereinafter, a structure and principle of the sensor 270 will be described.

FIG. 5 is a schematic view illustrating a state in which the sensor is disposed in the bypass passage, FIG. 6 is a view of the sensor according to an embodiment of the present disclosure, and FIG. 7 is a view illustrating a thermal flow around the sensor depending on a flow of air flowing through the bypass passage.

Referring to FIGS. 5 to 7, the sensor 270 may be disposed at one point in the bypass passage 230. Thus, the sensor 270 may contact the air flowing along the bypass passage 230, and an output value of the sensor 270 may be changed in response to a change in a flow rate of air.

The sensor 270 may be disposed at a position spaced from each of an inlet 231 and an outlet 232 of the bypass passage 230. For example, the sensor 270 may be positioned a central portion of the bypass passage 230.

Since the sensor 270 is disposed on the bypass passage 230, the sensor 270 may face the evaporator 30 within the left and right width range of the evaporator 30.

The sensor 270 may be, for example, a generated heat temperature sensor. Particularly, the sensor 270 may include a sensor printed circuit board (PCB) 271, a heat generating element 273 installed on the sensor PCB 271, and a sensing element 274 installed on the sensor PCB 271 to sense a temperature of the heat generating element 273.

The heat generating element 273 may be a resistor that generates heat when current is applied.

The sensing element 274 may sense a temperature of the heat generating element 273.

When a flow rate of air flowing through the bypass passage 230 is low, since a cooled amount of the heat generating element 273 by the air is small, a temperature sensed by the sensing element 274 is high.

On the other hand, if a flow rate of the air flowing through the bypass passage 230 is high, since the cooled amount of the heat generating element 273 by the air flowing through the bypass passage 230 increases, a temperature sensed by the sensing element 274 decreases.

The sensor PCB 271 may determine a difference between a temperature sensed by the sensing element 274 in a state in which the heat generating element 273 is turned off and a temperature sensed by the sensing element 274 in a state in which the heat generating element 273 is turned on.

The sensor PCB 271 may determine whether the difference value between the states in which the heat generating element 273 is turned on/off is less than a reference difference value.

For example, referring to FIGS. 4(*a*), 4(*b*), and 7, when an amount of frost generated on the evaporator 30 is small, a flow rate of air flowing to the bypass passage 230 is small. In this case, a heat loss of the heat generating element 273 is little, since a cooled amount of the heat generating element 273 by the air is small.

On the other hand, when the amount of frost generated on the evaporator 30 is large, a flow rate of air flowing to the bypass passage 230 is large. Then, the heat loss of the heat generating element 273 is large, since the cooled amount by the air flowing along the bypass passage 230 is large.

Thus, the temperature sensed by the sensing element 274 when the amount of frost generated on the evaporator 30 is large is less than that sensed by the sensing element 274 when the amount of frost generated on the evaporator 30 is small.

Thus, in this embodiment, when the difference between the temperature sensed by the sensing element 274 in the state in which the heat generating element 273 is turned on and the temperature sensed by the sensing element 274 in the state in which the heat generating element 273 is turned off is less than the reference temperature difference, it may be determined that the defrosting is required.

According to this embodiment, the sensor 270 may sense a variation in temperature of the heat generating element 273, which varies by the air of which a flow rate varies according to the amount of generated frost to accurately determine a time point, at which the defrosting is required, according to the amount of frost generated on the evaporator 30.

The sensor 270 may be further provided with a sensor housing 272 such that air flowing through the bypass passage 230 is prevented from directly contacting the sensor PCB 271, the heat generating element 273, and the temperature sensor 274. In a state in which the sensor housing 272 is opened at one side, an electric wire connected to the sensor PCB 271 may be drawn out and then the opened portion may be covered by a cover portion.

The sensor housing 272 may surround the sensor PCB 271, the heat generating element 273, and the temperature sensor 274.

FIG. 8 is a control block diagram of a refrigerator according to an embodiment of the present disclosure.

Referring to FIG. 8, the refrigerator 1 according to an embodiment of the present disclosure may include the sensor 270 described above, a defrosting device 50 operating for defrosting the evaporator 30, a compressor 60 for compressing refrigerant, a blowing fan 70 for generating air flow, and a controller 40 for controlling the sensor 270, the defrosting device 50, the compressor 60 and the blowing fan 70. The controller 40 may be an electronic processor.

The defrosting device 50 may include, for example, a heater. When the heater is turned on, heat generated by the heater is transferred to the evaporator 30 to melt frost generated on the surface of the evaporator 30. The heater may be connected to one side of the evaporator 30, or may be disposed spaced apart from a position adjacent to the evaporator 30.

The defrosting device 50 may further include a defrost temperature sensor. The defrost temperature sensor may detect an ambient temperature of the defrosting device 50. A temperature value detected by the defrost temperature sensor may be used as a factor that determines when the heater is turned on or off.

For example, after the heater is turned on, when a temperature value detected by the defrost temperature sensor reaches a specific temperature (hereinafter, referred to as "defrost completion temperature"), the heater may be turned off. The defrost completion temperature may be set to an initial temperature, and when residual frost is detected on the evaporator 30, the defrost completion temperature may be increased to a certain temperature. For example, the initial temperature may be 5 degrees.

The compressor 60 is a device for compressing low-temperature low-pressure refrigerant into a high-temperature high-pressure supersaturated gaseous refrigerant. Specifically, the high-temperature high-pressure supersaturated gaseous refrigerant compressed in the compressor 60 flows into a condenser (not shown). The refrigerant is condensed into a high-temperature high-pressure saturated liquid refrigerant, and the condensed high-temperature high-pressure saturated liquid refrigerant is introduced to an expander (not shown) and is expanded to a low-temperature low-pressure two-phase refrigerant.

Further, the low-temperature low-pressure two-phase refrigerant is evaporated as the low-temperature low-pressure gaseous refrigerant while passing through the evaporator 30. In this process, the refrigerant flowing through the evaporator 30 may exchange heat with outside air, that is, air flowing through the heat exchange space 222, thereby achieving air cooling.

The blowing fan 70 is provided in the cool air passage 212 to generate air flow. Specifically, when the blowing fan 70 is rotated, air passing through the evaporator 30 flows into the cool air passage 212 through the cool air inflow hole 221 and is then discharged to the storage compartment 11 through the cool air discharge hole 211.

The controller 40 may control the heat generating element 273 of the sensor 270 to be turned on at regular cycles.

In order to determine when defrosting is necessary, the heat generating element 273 may maintain a turned-on state for a predetermined period of time, and the temperature of the heat generating element 273 may be detected by the sensing element 274.

After the heat generating element 273 is turned on for the predetermined period of time, the heat generating element 273 is turned off, and the sensing element 274 may detect the temperature of the heat generating element 273 which is turned off. In addition, the sensor PCB 271 may determine whether the maximum value of the temperature difference between the turned-on/off state of the heat generating element 273 is equal to or less than a reference difference value.

In addition, it is determined that defrosting is necessary when the maximum value of the temperature difference between the turned-on/off states of the heat generating element 273 is equal to or less than the reference difference value, and the defrosting device 50 may be turned on by the controller 40.

Although it has been described above that the sensor PCB 271 determines whether the temperature difference between the turned-on/off states of the heat generating element 273 is equal to or less than the reference difference value, alternatively, the controller 40 may determine whether the temperature difference between the turned-on/off states of the heat generating element 273 is equal to or less than the reference difference value, and control the defrosting device 50 according to a result of the determination. That is, the sensor PCB 271 and the controller 40 may be electrically connected to each other.

When defrosting is completed through the defrosting device 50, the controller 40 may determine whether residual frost remains on the evaporator 30.

According to an embodiment, the controller 40 may perform defrosting based on a temperature difference value between the on/off states of the heat generating element 273, and when the defrosting is completed, it may be determined whether residual frost remains on the evaporator 30.

When it is determined that residual frost remains on the evaporator 30 even though the defrosting is completed, the controller 40 may ease a condition for entering the next defrosting operation. That is, when residual frost remains on the evaporator 30, a defrosting start time point for the next defrosting operation may be advanced.

When it is determined that residual frost remains on the evaporator 30 after the defrosting is completed, the controller 40 may increase the defrost completion temperature in the case of the next defrosting operation, thereby increasing a total operation time of the next defrosting operation.

Hereinafter, a method for detecting the amount of frost on the evaporator 30 using the heat generating element 273 will be described in detail with reference to the drawings.

FIG. 9 is a flowchart showing a method of performing a defrost operation by determining a time point when a refrigerator needs to be defrosted according to an embodiment of the present disclosure, and FIGS. 10(*a*) and 10(*b*) are views showing changes in a temperature of a heat generating element according to the on/off of the heat generating element before and after frost on the evaporator according to an embodiment of the present disclosure. The flowchart may be performed by the controller 40 according to instructions stored in a memory.

FIG. 10(*a*) shows a change in temperature of the freezing compartment and a change in temperature of the heat generating element before occurrence of frost on the evaporator 30, and FIG. 10(*b*) shows a change in temperature of the freezing compartment and a change in temperature of the heat generating element after occurrence of frost on the evaporator 30. In the present embodiment, it is assumed that a state before occurrence of frost is a state after a defrosting operation is completed.

Referring to FIGS. 9, 10(*a*), and 10(*b*), in step S21, the heat generating element 273 is turned on.

Specifically, the heat generating element 273 may be turned on in a state in which the cooling operation is being performed on the storage compartment 11 (e.g., freezing compartment).

Here, the state in which the cooling operation of the freezing compartment is performed may mean a state in which the compressor 60 and the blowing fan 70 are being driven.

As described above, when a change in the flow rate of the air increases as the amount of frost on the evaporator 30 is large or small, the detection accuracy of the sensor 260 may be improved. That is, when the change in the flow rate of the air is large as the amount of frost on the evaporator 30 is large or small, the amount of change in the temperature detected by the sensor 270 becomes large, so that the time point at the defrosting is necessary may be accurately determined.

it is possible to increase the accuracy of the sensor when frost on the evaporator 30 is detected in a state in which air flow occurs, that is, the blowing fan 70 is being driven.

As an example, as shown in FIGS. 10(*a*) and 10(*b*), the heat generating element 273 may be turned on at a certain time point S1 while the blowing fan 70 is being driven.

The blower fan 70 may be driven for a predetermined period of time to cool the freezing compartment. In this case, the compressor 60 may be driven at the same time. Therefore, when the blowing fan 70 is driven, the temperature Ft of the freezing compartment may decrease.

On the other hand, when the heat generating element 273 is turned on, the temperature detected by the sensing element 274, that is, the temperature Ht of the heat generating element 273 may increase rapidly.

Next, in step S22, it may be determined whether the blowing fan 70 is turned on.

As described above, the sensor 270 may detect a change in temperature of the heat generating element 273, which is changed due to air of which the flow rate is changed according to the amount of frost on the evaporator 30. Therefore, when no air flow occurs, it is difficult for the sensor 270 to accurately detect the amount of frost on the evaporator 30.

When the blowing fan 70 is being driven, in step S23, the temperature Ht1 of the heat generating element may be detected.

Specifically, the heat generating element 273 may be turned on for a predetermined period of time, and the temperature (Ht1) of the heat generating element 273 may be detected by the sensing element at a certain time point in the state in which the heat generating element 273 is turned on.

In the present embodiment, the temperature Ht1 of the heat generating element 273 may be detected at a time point at which the heat generating element 273 is turned on. That is, in the present disclosure, the temperature immediately after the heat generating element 273 is turned on may be detected. Therefore, the detection temperature Ht1 of the heat generating element may be defined as the lowest temperature in the state in which the heat generating element 273 is turned on.

Here, the temperature of the heat generating element 273 detected for the first time may be referred to as a "first detection temperature (Ht1)".

Next, in step S24, it is determined whether a first reference time T1 has elapsed while the heat generating element 273 is turned on.

When the heat generating element 273 is maintained in the turned-on state, the temperature detected by the sensing element 274, that is, the temperature Ht1 of the heat generating element 273 may continuously increase. However, when the heat generating element 273 is maintained in the turned-on state, the temperature of the heat generating element 273 may start to increase gradually and converge to the highest temperature point.

On the other hand, when the amount of frost on the evaporator 30 is large, the flow rate of the air flowing into the bypass passage 230 increases, and thus the amount of cooling for the heat generating element 273 by air flowing through the bypass passage 230 increases. Then, the highest temperature point of the heat generating element 273 may be low due to the large air flow through the bypass passage 230 (see FIG. 10(*b*)).

On the other hand, when the amount of frost on the evaporator 30 is small, the flow rate of the air flowing into the bypass passage 230 decreases, and thus the amount of cooling for the heat generating element 273 by air flowing through the bypass passage 230 decreases. Then, the highest temperature point of the heat generating element 273 may be high due to the small air flow through the bypass passage 230 (see FIG. 10(*a*)).

In the present embodiment, the temperature of the heat generating element 273 may be detected at a time point at which the heat generating element 273 is turned on. That is, in the present disclosure, the lowest temperature value of the heat generating element 273 is detected after the heat generating element 273 is turned on.

Here, the first reference time T1 for which the heat generating element 273 is maintained in the turned-on state may be 3 minutes but is not limited thereto.

When a predetermined period of time has elapsed while the heat generating element 273 is turned on, in step S25, the heat generating element 273 is turned off.

As in FIGS. 10(*a*) and 10(*b*), the heat generating element 273 may be turned on for the first reference time T1 and then turned off. When the heat generating element 273 is turned off, the heat generating element 273 may be rapidly cooled by air flowing through the bypass passage 230. Therefore, the temperature Ht of the heat generating element 273 may rapidly decrease.

However, when the turned-off state of the heat generating element 273 is maintained, the temperature Ht of the heat generating element may start to gradually decrease, and the decrease rate thereof is significantly reduced.

Next, in step S26, the temperature Ht2 of the heat generating element may be detected.

That is, the temperature Ht2 of the heat generating element is detected by the sensing element 273 at a certain time point S2 in a state in which the heat generating element 273 is turned off.

In the present embodiment, the temperature Ht2 of the heat generating element may be detected at a time point at which the heat generating element 273 is turned off. That is, in the present disclosure, the temperature immediately after the heat generating element 273 is turned off may be detected. Therefore, the detection temperature Ht2 of the heat generating element may be defined as the highest temperature in the state in which the heat generating element 273 is turned off.

Here, the temperature of the heat generating element 273 detected for the second time may be referred to as a "second detection temperature (Ht2)".

In summary, the temperature Ht of the heat generating element may be first detected at a time point S1 when the heat generating element 273 is turned on, and may be additionally detected at a time point S2 at which the heat generating element 273 is turned off. In this case, the first detection temperature Ht1 that is detected for the first time may be the lowest temperature in the state in which the heat generating element 273 is turned on, and the second detection temperature Ht2 that is additionally detected may be the highest temperature in the state in which the heat generating element 273 is turned off.

Next, in step S27, it is determined whether a temperature stabilization state has been achieved.

Here, the temperature stabilization state may mean a state in which internal refrigerator load does not occur, that is, a state in which the cooling of the storage compartment is normally performed. In other words, the fact that the temperature stabilization state is made may mean that the opening/closing of a refrigerator door is not performed or there are no defects in components (e.g., a compressor and an evaporator) for cooling the storage compartment or the sensor 270.

That is, the sensor 270 may accurately detect the amount of frost on the evaporator 30 by determining whether or not temperature stabilization has been achieved.

In the present embodiment, in order to determine whether the temperature stabilization state is achieved, it is possible to determine the amount of change in the temperature of the freezing compartment for a predetermined period of time. Alternatively, in order to determine whether the temperature stabilization state is achieved, it is possible to determine the amount of change in the temperature of the evaporator 30 for a predetermined period of time.

For example, a state in which the amount of change in temperature of the freezing compartment or in temperature of the evaporator 30 during the predetermined period of time does not exceed 1.5 degrees may be defined as the temperature stabilization state.

As described above, the temperature Ht of the heat generating element may rapidly decrease immediately after the heat generating element 273 is turned off, and then the temperature Ht of the heat generating element may gradually decrease. Here, it is possible to determine whether temperature stabilization has been achieved by determining whether the temperature Ht of the heat generating element decreases normally after decreasing rapidly.

When the temperature stabilization state is achieved, in step S28, the temperature difference ΔHt between the temperature Ht1 detected when the heat generating element 273 is turned on and the temperature Ht2 detected when the heat generating element 273 is turned off may be calculated.

In step S29, it is determined whether the temperature difference ΔHt is less than a first reference temperature value.

Specifically, when the amount of frost on the evaporator 30 is large, the flow rate of the air flowing into the bypass passage 230 increases, and thus the amount of cooling of the heat generating element 273 by air flowing through the bypass passage 230 may increase. When the amount of cooling increases, the temperature Ht2 of the heat generating element detected immediately after the heat generating element 273 is turned off may be relatively low compared to a case where the amount of frost on the evaporator 30 is small.

As a result, when the amount of frost on the evaporator 30 is large, the temperature difference ΔHt may be small. Accordingly, it is possible to determine the amount of frost on the evaporator 30 through the temperature difference ΔHt. Here, the first reference temperature value may be 32 degrees, for example.

Next, when the temperature difference ΔHt is less than the first reference temperature value, in step S30, a defrosting operation is performed.

When the defrosting operation is performed, the defrosting device 50 is driven and heat generated by the heater is transferred to the evaporator 30 so that the frost generated on the surface of the evaporator 30 is melted.

On the other hand, in step S27, when the temperature stabilization state is not achieved or, in step S29, when the temperature difference ΔHt is greater than or equal to the first reference temperature value, the algorithm ends without performing the defrosting operation.

As shown in FIGS. 10(*a*) and 10(*b*), the heat generating element 273 may be turned on for the first reference time T1 and then turned off. When the heat generating element 273 is turned off, the heat generating element 273 may be rapidly cooled by air flowing through the bypass passage 230. Therefore, the temperature Ht of the heat generating element 273 may rapidly decrease.

In the present embodiment, the temperature difference value ΔHt may be defined as a "logic temperature" for detection of frosting. The logic temperature may be used as a temperature for determining a time point for a defrosting operation of the refrigerator, and may be used as a temperature for detecting residual frost of the evaporator 30, which will now be described.

FIG. 11 is a flow chart showing a method for detecting residual frost on an evaporator after completion of defrosting according to an embodiment of the present disclosure. The flow chart may be performed by the controller 40 according to instructions stored in the memory.

Referring to FIG. 11, in step S41, the logic temperature ΔHt is updated after the defrosting is completed.

Here, updating the logic temperature ΔHt may mean that steps S21 to S28 of FIG. 9 described above are performed again.

Specifically, after the defrosting operation is completed in step S30 of FIG. 9 described above, steps S21 to S28 are performed again, and the temperature difference value ΔHt between the temperature Ht1 detected in a state in which the heat generating element 273 is turned on, and the temperature Ht2 detected in a state in which the heat generating element 273 turned off may be calculated.

Next, in step S43, it is determined whether the updated logic temperature ΔHt is less than a second reference temperature value.

Here, the second reference temperature value may be a reference temperature value for determining whether residual frost remains on the evaporator 30 even though the defrosting has been completed. That is, it may be understood that residual frost exists on the evaporator 30 when the updated logic temperature ΔHt is less than the second reference temperature value, and no residual exists on the evaporator 30 when the updated logic temperature ΔHt is greater than or equal to the second reference temperature value.

Here, the second reference temperature value may be a value higher than the first reference temperature value described above. For example, the second reference temperature value may be 36 degrees.

When the updated logic temperature ΔHt is less than the second reference temperature value, in step S45, the controller 40 may control to ease a condition for entering the next defrost operation.

Specifically, the fact that the updated logic temperature ΔHt is less than the second reference temperature value may mean that residual frost exists on the evaporator 30 even after the defrosting has been completed. Therefore, in this case, the next defrost time point may be advanced by increasing the defrost start temperature for the next defrosting operation.

Here, the defrost start temperature may be, for example, the first reference temperature value.

That is, when residual frost exists on the evaporator 30, the next defrosting operation may be accelerated by increasing the first reference temperature value by a predetermined temperature.

According to an embodiment, when residual frost exists on the evaporator 30, the first reference temperature value may be set to increase by 2 degrees from 32 degrees to 34 degrees. Then, when the first reference temperature value is set to 34 degrees, the next defrosting operation time point may be further advanced compared to a case where the first reference temperature value is set to 32 degrees.

Here, a temperature value which has been increased by a predetermined temperature (e.g., 2 degrees) may be referred to as "a third reference temperature value".

Therefore, as a result, after the initial defrosting is completed, the defrost time point until the next defrosting operation may be advanced, so that residual frost remaining on the evaporator 30 may be effectively removed.

Alternatively, when residual frost remains on the evaporator 30, the defrost completion temperature may be increased during the next defrosting operation. That is, when it is determined that residual frost exists on the evaporator 30, the starting time point for the next defrost operation may not be advanced, but the defrosting operation time (total defrost time) during the next defrost operation may be increased.

For example, when residual ice exists on the evaporator 30, the defrost completion temperature may be set to 11 degrees, which has been increased by a predetermined temperature (e.g., 6 degrees) from 5 degrees which is the existing temperature. Then, when the defrost completion temperature is set to 11 degrees, the total defrost operation time may be longer compared to a case where the defrost completion temperature is set to 5 degrees, so that residual frost formed on the evaporator 30 can be effectively removed.

FIG. 12 is a flow chart showing a detailed method for detecting residual frost on an evaporator after completion of defrosting according to an embodiment of the present disclosure. The flow chart may be performed by the controller 40 according to instructions stored in the memory.

Referring to FIG. 12, in step S51, a logic temperature ΔHt may be updated. Here, updating the logic temperature ΔHt may mean that steps S21 to S28 of FIG. 9 described above are performed again.

Next, in step S52, it is determined whether the update of the logic temperature ΔHt is the first update of the logic temperature after the defrosting has been completed.

Here, the reason to determine whether the update of the logic temperature ΔHt is the first update of the logic temperature after the defrosting has been completed is to increase the next defrost operation time in order to effectively remove the residual frost of the evaporator 30.

When the update of the logic temperature ΔHt is the first update of the logic temperature after completion of the defrosting, it is determined in step S53 whether the updated logic temperature ΔHt is less than the second reference temperature value.

Here, the second reference temperature value may be a reference temperature value for determining whether residual frost remains on the evaporator 30 even though the defrosting has been completed. That is, it may be understood that residual frost exists on the evaporator 30 when the updated logic temperature ΔHt is less than the second reference temperature value, and residual frost may not exist on the evaporator 30 when the updated logic temperature ΔHt is greater than or equal to the second reference temperature value.

Here, the second reference temperature value may be a value higher than the first reference temperature value described above. For example, the second reference temperature value may be 36 degrees.

When the updated logic temperature ΔHt is less than the second reference temperature value, in step S54, the controller 40 may increase the defrost completion temperature in the next defrosting operation.

For example, when residual ice exists on the evaporator 30, the defrost completion temperature may be set to 11 degrees, which has been increased by a predetermined temperature (e.g., 6 degrees) from 5 degrees which is the existing temperature. Then, when the defrost completion temperature is set to 11 degrees, the total defrost operation time may be longer compared to a case where the defrost completion temperature is set to 5 degrees, thus effectively removing residual frost formed on the evaporator 30.

When the defrost completion temperature is set to increase by a predetermined temperature, the process may return to step S51.

On the other hand, when the updated logic temperature ΔHt is greater than or equal to the second reference temperature value, that is, when no residual frost exists on the evaporator 30, the defrost completion temperature may not be increased, and the process may return to step S51 while maintaining the defrost completion temperature (e.g., 5 degrees).

On the other hand, when the update of the logic temperature ΔHt is not the first update of the logic temperature after completion of the defrosting, it is determined in step S55 whether the updated logic temperature ΔHt is less than the second reference temperature value.

When the updated logic temperature ΔHt is less than the second reference temperature value, in step S57, it may be determined whether the updated logic temperature ΔHt is less than the third reference temperature value.

Here, step S55 may be a step of determining whether residual frost remains on the evaporator 30, and step S57 may be a step of determining whether a defrosting operation is additionally required.

In this case, the third reference temperature value may be defined as a defrost start temperature for starting defrosting. The third reference temperature value may be a value greater than the first reference temperature value and less than the second reference temperature value.

That is, when residual frost remains on the evaporator 30, a defrosting start time point may be advanced by easing a condition for entering defrosting for start of next defrosting. In other words, when residual frost remains on the evaporator 30, it may be possible to change the defrost start temperature for starting defrosting from the existing first reference temperature value (e.g., 32 degrees) to the third reference temperature value (e.g., 34 degrees) to make the defrost time point earlier.

When the updated logic temperature ΔHt is less than the third reference temperature value, that is, when residual frost remains on the evaporator 30, in step S58, defrosting may be performed until the defrost completion temperature is reached.

Specifically, when the updated logic temperature ΔHt is less than the second reference temperature value and the third reference temperature value, the controller 40 may drive a heater of the defrosting device 50 to remove any residual frost.

In this case, the defrost completion temperature may be a temperature which has been increased by a predetermined temperature from an initially set defrost completion temperature. Accordingly, the total operation time of the defrosting operation additionally performed may be greater than the total operation time of the defrost operation initially performed. Accordingly, when defrosting is completed in a case where the defrost completion temperature is reached, most of the residual frost that was remaining on the evaporator 30 may be removed.

When defrosting is performed until the defrost completion time point, in step S59, the controller 40 may initialize the defrost completion temperature.

Specifically, when defrosting is performed until the defrost completion time point and residual frost of the evaporator 30 is sufficiently removed, the defrost completion temperature may be initialized to the initial defrost completion temperature. That is, the defrost completion temperature may be set again to 5 degrees, which is the existing initial defrost completion temperature.

On the other hand, in step S55, when the updated logic temperature ΔHt is greater than or equal to the second reference temperature value, that is, when no residual frost remains on the evaporator 30, the defrosting operation may not be performed, and the process may return to step S51.

In step S55, even though the updated logic temperature ΔHt is greater than or equal to the second reference temperature value, in step S57, when the updated logic temperature ΔHt is greater than or equal to the third reference temperature value, that is, when residual frost remains on the evaporator 30 but the defrosting operation is not required, the defrosting operation may not be performed and the process may return to step S51.

In summary, for example, when it is assumed that the logic temperature ΔHt that is updated for the first time after the defrosting has been completed is 33 degrees, in step S54, the defrost completion temperature may be increased and set during the next defrosting operation. Assuming that the logic temperature ΔHt which is updated for the second time after completion of the defrosting, it may be determined that residual frost remains on the evaporator 30 in step S58, and defrosting may be again performed until the set defrost completion temperature is reached.

That is, when residual frost still exists on the evaporator 30 after the first defrosting, it may be possible to increase the defrost completion temperature during the next defrosting operation, the next defrost time point may be further advanced by easing the condition for entering the next defrosting operation, and residual frost on the evaporator 30 may be effectively removed by increasing the total defrosting operation time.

In the present embodiment, it has been described that the first detection temperature (Ht1) may be a temperature detected by a sensing element of the sensor immediately after the heat generating element is turned on, and the second detection temperature (Ht2) may be a temperature detected by a sensing element of the sensor immediately after the heat generating element is turned off, but the present embodiment is not limited thereto.

According to another embodiment, the first detection temperature Ht1 and the second detection temperature Ht2 may be temperature values detected while the heat generating element is turned on. For example, the first detection temperature Ht1 may be a lowest temperature value during a period of time when the heat generating element is turned on and the second detection temperature Ht2 is a highest temperature value during the period of time when the heat generating element is turned on.

The invention claimed is:

1. A control method by a refrigerator comprising:

operating a heat generating element of a sensor reacting to a change in a flow rate of air for a predetermined period of time;

detecting a temperature of the heat generating element, a first detection temperature that is sensed by a sensor in response to the heat generating element turned on and a second detection temperature that is sensed by the sensor in response to the heat generating element turned off, wherein the second detection temperature is sensed in response to the turning off after the heat generating element maintained the turning on for sensing the first detection temperature;

performing a defrosting operation of an evaporator when a temperature difference value between the first detection temperature and the second detection temperature is less than a first reference difference value;

updating the temperature difference value between the first detection temperature and the second detection temperature after the defrosting operation is completed;

detecting residual frost on the evaporator based on the temperature difference between the first detection temperature and the second detection temperature among detection temperatures of the heat generating element.

2. The control method of claim 1, wherein the first detection temperature is a temperature detected by a sensing element of the sensor after the heat generating element is turned on.

3. The control method of claim 1, wherein the second detection temperature is a temperature detected by a sensing element of the sensor after the heat generating element is turned off.

4. The control method of claim 1, wherein the first detection temperature is a lowest temperature value during a period of time when the heat generating element is turned on.

5. The control method of claim 1, wherein the second detection temperature is a highest temperature value during a period of time when the heat generating element is turned on.

6. The control method of claim 1, further comprising:

easing a condition for entering a next defrosting operation when the updated temperature difference value is less than a second reference value.

7. The control method of claim 6, wherein the second reference value has a value which is higher than the first reference value.

8. The control method of claim 6, further comprising:

increasing the first reference value for performing the next defrosting operation when the updated temperature difference value is less than the second reference value.

9. The control method of claim 6, further comprising:

increasing a total operation time of the next defrosting operation by increasing a defrost completion temperature when the updated temperature difference value is less than the second reference value.

10. The control method of claim 6, further comprising:

determining whether the temperature difference value between the first detection temperature and the second detection temperature is updated for the first time after the defrosting operation is completed.

11. The control method of claim 10, further comprising:

increasing a total operation time of a next defrosting operation by increasing a defrost completion temperature in the next defrosting operation when the temperature difference value between the first detection temperature and the second detection temperature is updated for the first time after the defrosting operation is completed.

12. The control method of claim 10, further comprising:

determining whether the updated temperature difference value is less than a third reference value when it is determined that the temperature difference value between the first detection temperature and the second detection temperature is updated for the first time after the defrosting operation is completed; and performing the defrosting operation again when the updated temperature difference value is less than the third reference value.

13. The control method of claim 12, wherein the third reference value has a value which is less than the first reference value and higher than the second reference value.

14. A refrigerator comprising:

an inner case including a storage space;

a cooling duct to guide flow of air in the storage space and defining a heat exchange space with the inner case;

an evaporator disposed in the heat exchange space;

a bypass passage recessed from the cooling duct to allow a portion of the air flow to bypass the evaporator;

a sensor including a heat generating element disposed in the bypass passage and a sensing element to detect a temperature of the heat generating element; and a controller configured to detect residual frost on the evaporator based on a temperature difference between a first detection temperature and a second detection temperature among detection temperatures of the heat generating element after a defrosting operation for the evaporator is completed, wherein the second detection temperature is sensed in response to the turning off after the heat generating element maintained the turning on for sensing the first detection temperature.

15. The refrigerator of claim 14, wherein the first detection temperature is a temperature detected by a sensing element of the sensor after the heat generating element is turned on, and the second detection temperature is a temperature detected by a sensing element after the heat generating element of the sensor is turned off.

16. The refrigerator of claim 14, wherein the first detection temperature is a lowest temperature value during a period of time when the heat generating element is turned on, and the second detection temperature is a highest temperature value during a period of time when the heat generating element is turned on.

17. The refrigerator of claim 14, wherein the controller is configured to:

perform a defrosting operation of the evaporator, when the temperature difference value between the first sensing temperature and the second sensing temperature is less than a first reference value, and update the temperature difference value between the first detection temperature and the second detection temperature after the defrosting operation is completed, and when the updated temperature difference value is less than a second reference value, ease a condition for entering a next defrosting operation.

18. The refrigerator of claim 14, wherein the controller is configured to increase the first reference value for performing the next defrosting operation when the updated temperature difference value is less than the second reference value.

19. The refrigerator of claim 14, wherein the controller is configured to increase a total operation time of the next defrosting operation by increasing a defrost completion temperature when the updated temperature difference value is less than the second reference value.

20. The refrigerator of claim 14, further comprising a passage cover to cover the bypass passage so as to partition the bypass passage from the heat exchange space.

* * * * *